US008950808B2

(12) United States Patent
Kummerfeld et al.

(10) Patent No.: US 8,950,808 B2
(45) **Date of Patent: *Feb. 10, 2015**

(54) STOWABLE BABY SEAT AND METHODS

(71) Applicant: The Boppy Company, LLC, Golden, CO (US)

(72) Inventors: Jamie Kummerfeld, Wheat Ridge, CO (US); Paul Fair, Denver, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/281,396

(22) Filed: May 19, 2014

(65) Prior Publication Data

US 2014/0339862 A1 Nov. 20, 2014

Related U.S. Application Data

(63) Continuation of application No. 13/564,617, filed on Aug. 1, 2012, now Pat. No. 8,764,109.

(60) Provisional application No. 61/531,536, filed on Sep. 6, 2011.

(51) Int. Cl.

| | |
|---|---|
| ***A47C 1/08*** | (2006.01) |
| ***A47D 1/10*** | (2006.01) |
| ***A47D 1/02*** | (2006.01) |
| ***A47B 83/02*** | (2006.01) |

(52) U.S. Cl.

CPC .. *A47D 1/02* (2013.01); *A47B 83/02* (2013.01)
USPC ..... 297/250.1; 297/270.2; 297/174 R; 297/219.12; 297/440.12; 297/452.13; 297/255; 297/174 CS

(58) Field of Classification Search

USPC ..... 297/296, 270.2, 188.2, 452.13, 250.1, 297/16.1, 16.2, 255, 440.12, 174 R, 174 CS, 297/219.1, DIG. 11, 270.5, 219.12; D6/333, D6/361; 5/655; 4/572.1

See application file for complete search history.

(56) References Cited

U.S. PATENT DOCUMENTS

| | | | | |
|---|---|---|---|---|
| 3,012,815 | A | | 12/1961 | Smith |
| 4,094,547 | A | * | 6/1978 | Zampino et al. ..... 297/182 |
| 4,553,786 | A | | 11/1985 | Lockett et al. |
| 4,650,246 | A | | 3/1987 | Henriksson |
| D291,748 | S | | 9/1987 | Henriksson |
| 5,187,826 | A | | 2/1993 | Mariol |
| 5,207,478 | A | | 5/1993 | Freese et al. |
| 5,269,591 | A | | 12/1993 | Miga et al. |
| 5,308,143 | A | | 5/1994 | Cheng et al. |
| D348,309 | S | | 6/1994 | Freese et al. |
| 5,317,765 | A | | 6/1994 | Knoedler et al. |
| 5,460,430 | A | | 10/1995 | Miga et al. |
| 5,507,550 | A | | 4/1996 | Maloney |
| 5,509,721 | A | | 4/1996 | Huang |

(Continued)

FOREIGN PATENT DOCUMENTS

WO 2006/005965 1/2006

*Primary Examiner* — Chi Q Nguyen

(74) *Attorney, Agent, or Firm* — Kilpatrick Townsend & Stockton LLP

(57) ABSTRACT

An infant chair includes a frame having a seat portion and a base portion that are pivotally connected to each other so as to be movable between an expanded position and a collapsed position. A locking mechanism is operable to lock the frame in the expanded position. Further, a cover is configured to substantially cover the frame.

20 Claims, 27 Drawing Sheets

(56) References Cited

U.S. PATENT DOCUMENTS

| | | | |
|---|---|---|---|
| 6,341,816 | B1 | 1/2002 | Chen et al. |
| 6,626,487 | B1 | 9/2003 | Buitendach |
| 6,629,727 | B2 | 10/2003 | Asbach et al. |
| 6,739,649 | B2 | 5/2004 | Kelly et al. |
| 6,811,217 | B2 | 11/2004 | Kane et al. |
| 6,969,120 | B2 | 11/2005 | Levin |
| 7,201,445 | B1 | 4/2007 | Dubiel et al. |
| D550,971 | S | 9/2007 | McConnell |
| D553,865 | S | 10/2007 | Buitendach |
| 7,374,241 | B2 | 5/2008 | Gold |
| 7,418,752 | B2 | 9/2008 | Kemm |
| 7,422,276 | B2 | 9/2008 | Flannery |
| D592,865 | S | 5/2009 | Yeung |
| 7,591,506 | B2 | 9/2009 | Flannery |
| D604,055 | S | 11/2009 | Plested et al. |
| D608,102 | S | 1/2010 | Kemm |
| 7,676,871 | B1 | 3/2010 | Leach |
| D613,081 | S | 4/2010 | Poran |
| 7,698,764 | B2 | 4/2010 | Kemm |
| 7,708,342 | B2 | 5/2010 | Leach |
| 8,764,109 | B2 | 7/2014 | Kummerfeld et al. |
| 2008/0054696 | A1 | 3/2008 | McConnell et al. |

* cited by examiner

STOWABLE BABY SEAT AND METHODS

CROSS REFERENCES TO RELATED APPLICATIONS

This application is a continuation of Ser. No. 13/564,617, filed Aug. 1, 2012 (U.S. Pat. No. 8,764,109), which is a continuation-in-part and claims the benefit of U.S. Provisional Application No. 61/531,536, filed on Sep. 6, 2011, the complete disclosures of which are herein incorporated by reference.

BACKGROUND OF THE INVENTION

This invention relates generally to the field of chairs. In particular, the invention relates to chairs suitable for use with infants and small children.

Parents have long sought for ways to hold their infants or small children, especially when they reach the age where they are able to sit upright. For example, it is often convenient to prop up a baby during feeding. While numerous baby chairs are currently on the market, there is still a need for chairs to accommodate the needs of both parents and infants. As such, the invention provides various embodiments of infant chairs that are convenient to use, transport and store, as well as providing a comfortable sitting environment for the infant.

BRIEF SUMMARY OF THE INVENTION

One embodiment of the invention provides a chair that comprises a frame having a seat portion and a base portion that are pivotally connected to each other so as to be movable between an expanded position and a collapsed position. A locking mechanism is operable to lock the frame in the expanded position. A cover is configured to substantially cover the frame and has a curved back, two side arms, and a seat. In some embodiments, the cover may further include an exterior and an interior, and the interior includes a slotted region that extends along the arms and the curved back to receive at least some of the seat portion of the frame. Also, the seat of the cover is suspended by the seat portion of the frame.

In one aspect, a horn is coupled to the seat portion of the frame and is configured to be positioned between a baby's legs. In some cases, the horn may be incorporated into the cover so as to be positioned between a baby's legs. In another aspect, a tray is provided and is designed to be coupled to the horn. The tray may include a latch to engage the horn.

In a further aspect, the frame comprises curved elongate members that define an outer shape of the chair. These elongate members may be tubular in geometry and may be constructed of a material such as metal or plastic.

In some cases, the cover may further include an elastic bottom that is configured to constrict about the frame. This may permit the cover to be removable. In other aspects, the cover may include a bottom and at least one connector near the bottom to couple the cover to the frame. Optionally, a restraint system may be coupled to the cover and may be used to hold a baby within the chair.

The locking mechanism may comprise a top member that is coupled to a bottom member by a hinge and a spring loaded tooth that extends from the bottom member to engage the top member when in the expanded position. In this way, the tooth is retractable to disengage the tooth from the top member to permit the locking member to pivot about the hinge. In some cases, a tether may be operably coupled to the tooth and may be pulled to disengage the tooth. Also, a pull member may be coupled to the cover at the back and may be pulled to facilitate movement to the collapsed position.

In one particular aspect, the horn may include at least one groove, and the tray may include at least one protrusion to slide within the groove. Also, a removable padding member may be provided and positioned on the seat and adjacent the back to facilitate holding of a baby in the seat. Further, at least one strap may be coupled to the cover and used to strap the chair to a surface. Conveniently, the cover may include a pocket for holding the strap.

In still another aspect, a pair of coupling members may pivotally couple the seat portion to the base portion.

In a further embodiment, the invention provides a chair that comprises a frame having a seat portion and a base portion that are pivotally connected to each other so as to be movable between an expanded or extended position and a collapsed position. Also, the frame has a front and a back. A locking mechanism is operable to lock the frame in the expanded position. The locking mechanism is positioned at the back of the frame and is coupled at a top end to the seat portion and at a bottom end to the base portion. The locking mechanism also includes a hinge that permits the locking mechanism to pivot when the frame is moved from the extended position to the collapsed position. A cover is also positioned about the frame. Such a chair may be reconfigured by operating the locking mechanism to cause the locking mechanism to pivot about a hinge to move the frame from the expanded position to the collapsed position.

The invention further provides various embodiments of chairs, as well as methods for assembling and using such chairs. For example, one embodiment of a baby chair comprises a frame having a seat portion and a base portion that are pivotally connected to each other so as to be movable between an expanded position and a collapsed position. A locking mechanism is operable to lock the frame in the expanded position. Further, a removable slipcover is configured to substantially cover the frame. The slipcover has a curved back, two curved side arms, and a seat, as well as an exterior and an interior. The interior includes a slotted region that extends along the curved arms and curved back to receive the seat portion of the frame. In this way, the chair may be assembled simply by manipulating the frame until locked into the extended position and then placing the slipcover over the frame. To place the chair in the collapsed position (such as when travelling or storing the chair), access is gained to the locking mechanism and the frame is folded to the collapsed position. The slipcover may remain over the frame when folding the chair. When needed, the slipcover may optionally be removed from the frame and the locking mechanism operated to permit the frame to be placed in the collapsed position. When disassembled, the cover may also be easily washed, such as in a washing machine.

In one aspect, the seat of the slipcover is suspended by the seat portion of the frame. Also, a rigid seat member may be incorporated into the seat.

In another aspect, a horn may be coupled to the seat portion of the frame so as to be positioned between an infant's legs. In some cases, a removable a tray may be coupled to the horn.

The frame may comprise curved elongate members that define an outer shape of the chair. For example, the frame may be constructed of rigid tubing or rods.

In another aspect, the slipcover further includes an elastic bottom that is configured to constrict about the frame. Further, a restraint system may be coupled to the slipcover that is adapted to hold an infant within the chair.

DETAILED DESCRIPTION OF THE INVENTION

In certain embodiments, infant chairs may be constructed of a frame and a cover that is positioned over the frame. Conveniently, the frame may be movable between an expanded position and a collapsed position for easy transport and storing. A locking mechanism may be used to lock the frame in the expanded position.

Figure 1:
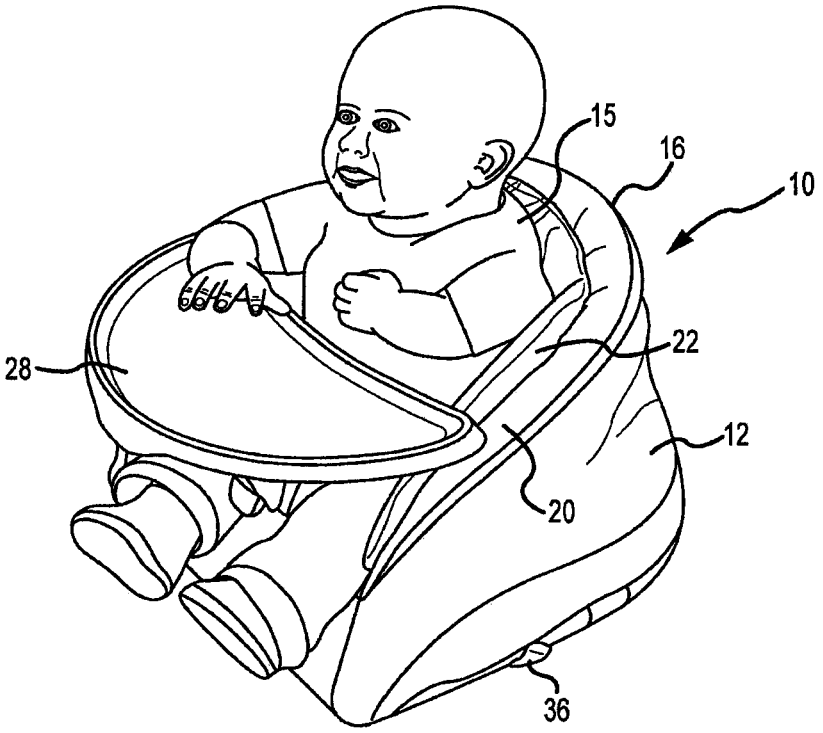
FIG. 1 is a perspective front view of one embodiment of a chair according to the invention, with the chair being shown holding a baby.

Referring now to FIGS. 1-11, one embodiment of a chair 10 that is particularly well suited for holding a baby will be described. Chair 10 is constructed generally of a flexible fabric cover 12 that is placed over an internal frame 14 (see FIGS. 12-14). As shown in FIG. 1, chair 10 is in an expanded or extended configuration to provide a convenient sitting area for holding a baby 15. Chair 10 is particularly well suited for holding babies up to about nine months, and more typically up to about six months in age. However, in some cases, chair 10 could be constructed to hold larger babies or children.

For convenience of discussion, chair 10 may be defined in terms of a curved back 16 and two side arms 18 and 20. Chair 10 is designed so that the baby's back is positioned against back 16 while side arms 18 and 20 rest near the sides of the baby to provide support not only to the baby's back but also to the baby's sides so that the baby does not tip from side to side. Optionally, a removable padded member 22 may be placed against back 16 and side arms 18 and 20 to provide additional support and comfort to the baby. Another particular advantage of padded member 22 is that it may be used when the baby is younger and therefore smaller in size. In this way, padded member 22 helps stabilize the baby while sitting up. As the baby grows and becomes larger, the padded member 22 may be removed. In this way, the usable life of chair 10 may be extended by simply removing padded member 22 so that the sitting area of chair 10 is larger in size.

Figure 2:
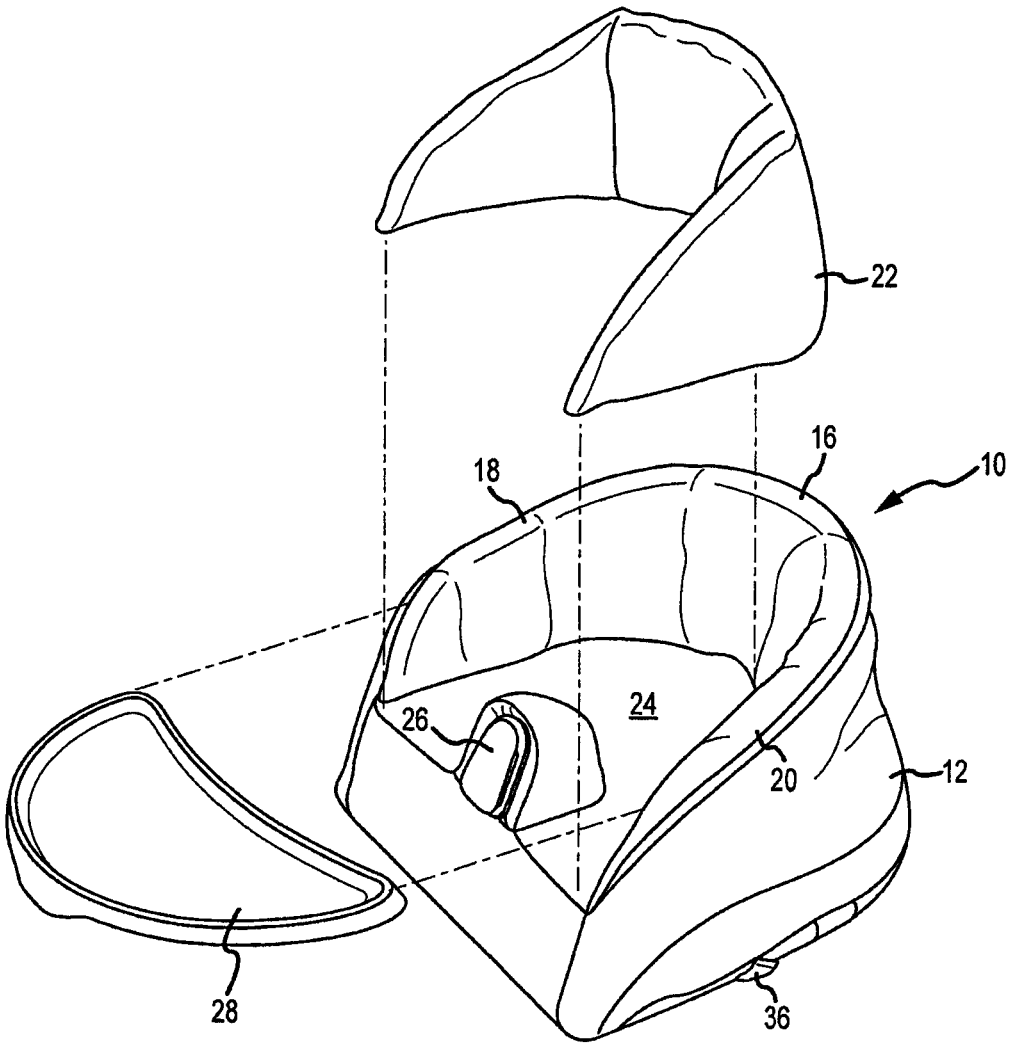
FIG. 2 illustrates the chair of FIG. 1 with a tray and padding member being removed.

As best shown in FIG. 2, chair 10 includes a seat 24 that is positioned at the base of back 16 and side arms 18 and 20. Generally, back 16 and side arms 18 and 20 will be perpendicular relative to seat 24. However, in some cases, back 16 and side arms 18 and 20 could be slightly angled outward relative to seat 24. A horn 26 extends upward from the front edge of seat 24 and provides a variety of functions. One advantage of horn 26 is that it rests between the baby's legs while the baby is in the sitting position shown in FIG. 1. In this way, horn 26 serves as a safety mechanism to prevent the baby from sliding off of the edge of seat 24. Horn 26 also provides a platform for holding items such as a tray 28 or other devices that may be coupled to the horn, such as toys, infant accessory items, and the like. When tray 28 is coupled to horn 26 as shown in FIG. 1, tray 28 also helps to hold the baby in the upright position and to prevent the baby from falling forward out of seat 24.

Figure 7:
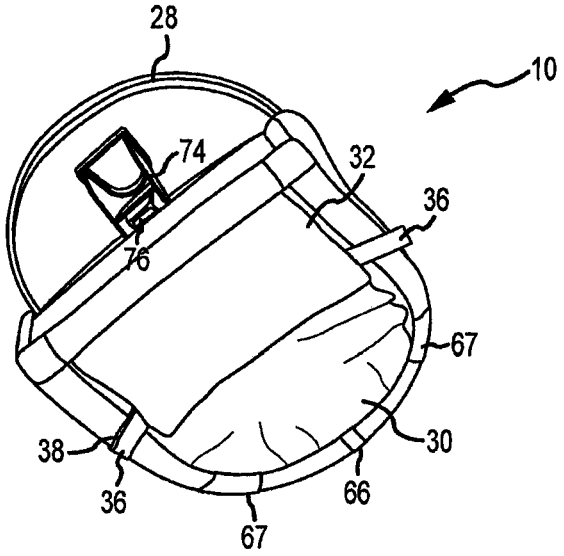
FIG. 7 is a bottom view of the chair of FIG. 1.
Figure 8:
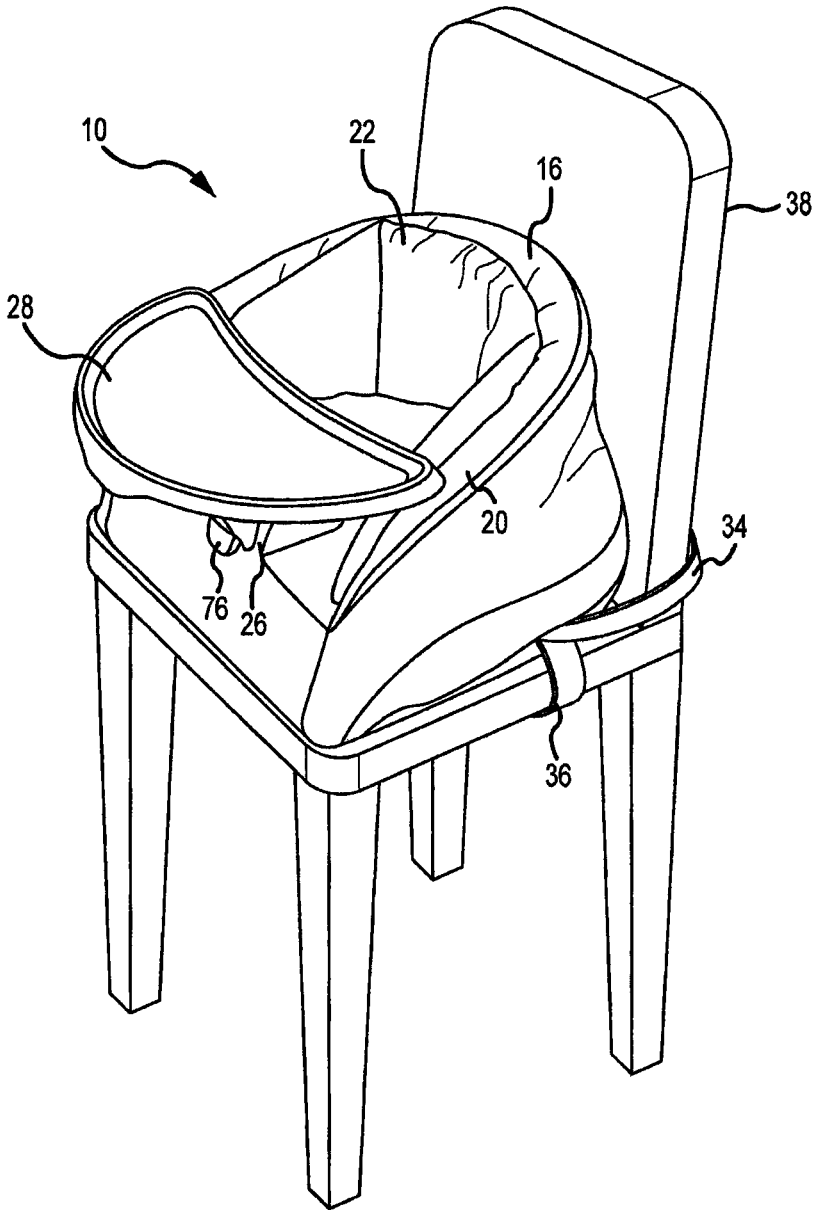
FIG. 8 illustrates the chair of FIG. 1 secured to an adult chair.
Figure 9:
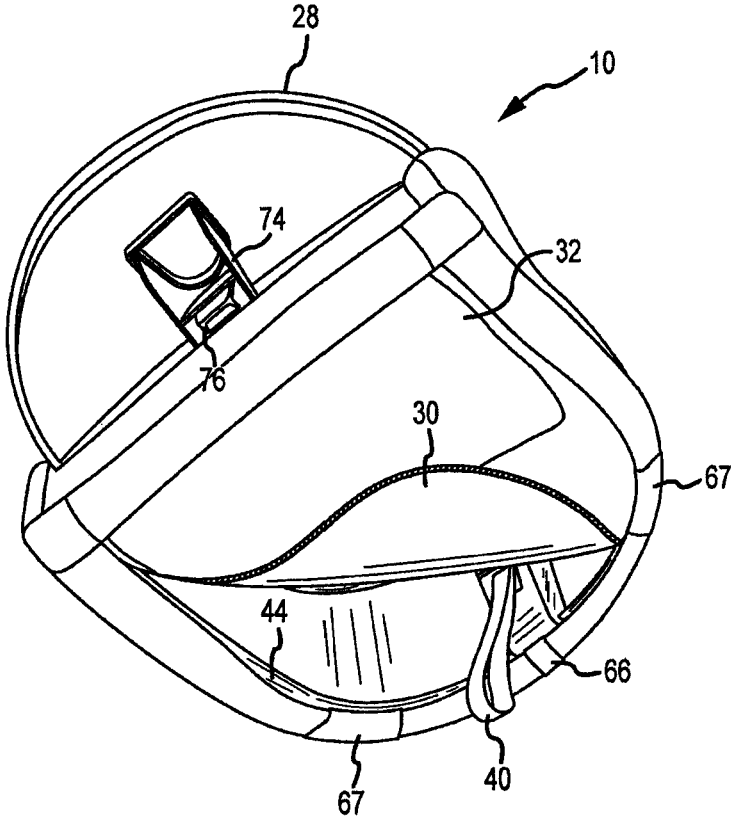
FIG. 9 illustrates a bottom view of the chair of FIG. 1 with a bottom panel partially removed to show the interior of the chair.
Figure 10:
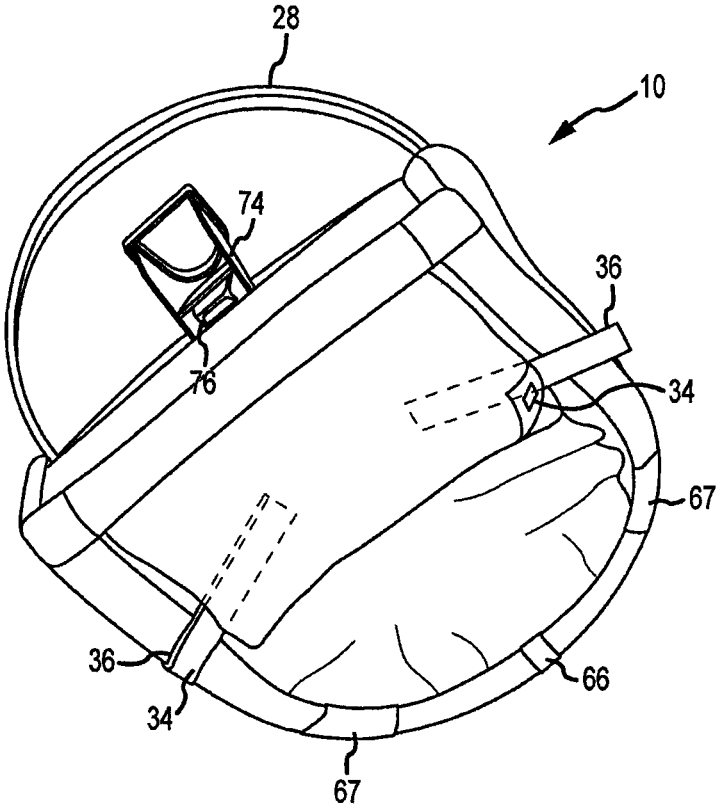
FIG. 10 is a bottom view of the chair of FIG. 1 showing pockets for holding a set of securing straps.

As best shown in FIGS. 7 and 9, cover 12 may include a bottom panel 30 that covers the bottom of chair 10. Panel 30 may be partially or fully removable from cover 12 to expose the interior of cover 12. For example, a fastening mechanism, such as a zipper, a hook-and-loop fastener material, ties, clips, buttons, or the like may be used to hold bottom panel 30 in place as shown in FIG. 7. The fastener mechanism may be operated to permit bottom panel 30 to be pulled or peeled away as illustrated in FIG. 9, thereby exposing the interior of cover 12. In some cases, bottom panel 30 may also include one or more pockets 32 that may optionally be used to store one or more securing straps 34 and 36. As best shown in FIG. 8, straps 34 may be placed around the back and/or underneath the seat of a traditional or adult chair 38 while straps 36 may be placed around the back and/or underneath the seat of chair 38 so that chair 10 is coupled to chair 38 at two locations. In this way, a traditional or an adult type chair may be converted for use with a baby by simply permitting chair 10 to be coupled to chair 38 in the manner shown. Although shown coupled to an adult chair, it will be appreciated that chair 10 may be coupled to or rest upon a variety of other objects or surfaces, such as on the bare ground, on the floor, on other types of chairs, and the like. When straps 34 and 36 are not in use (such as when chair 10 is placed on the floor), straps 34 and 36 may be tucked into pockets 32 so that they are conveniently stored. Straps 34 and 36 may comprise a variety of materials, such as nylon webbing, ties, laces, elastomers, and the like. One or more fasteners may also be used to connect the straps together.

One particularly convenient feature of chair 10 is that it may be easily placed in a collapsed position (see FIG. 11) when chair 10 is transported or otherwise stored. Moving chair 10 from the extended position to the collapsed position may be easily accomplished by pulling on a tether 40 which operates an internal locking mechanism and allows the chair 10 to be moved from the extended configuration shown in FIG. 1 to the collapsed configuration of FIG. 11. When chair 10 is to be placed in the extended position, the user may grasp a pull tab 42 on the back of chair 10 and pull outward while lifting on the top of chair 10 to move it back into the extended position where it will be locked into place as described in greater detail hereinafter. As shown, tab 42 is in the shape of a fabric loop. However, it will be appreciated that other types of pull mechanisms may be provided, including fabric sections, other loops, strings, and the like.

Figure 12:
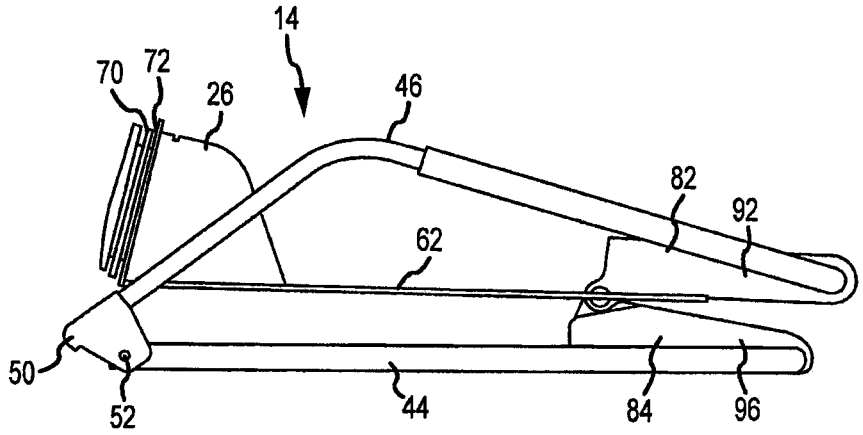
FIG. 12 illustrates the chair of FIG. 11 with the cover removed.
Figure 13:
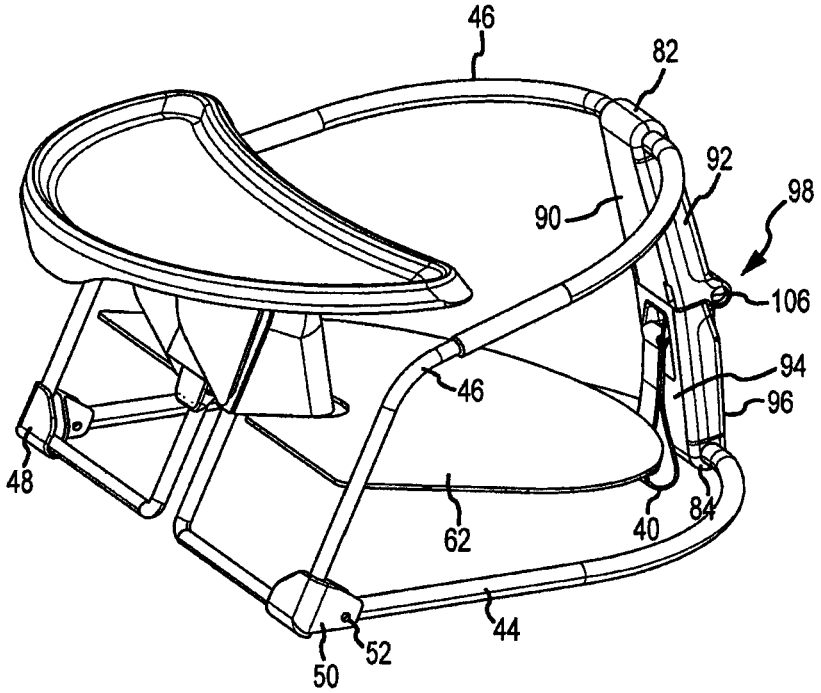
FIG. 13 illustrates the chair of FIG. 1 with the cover removed.
Figure 14:
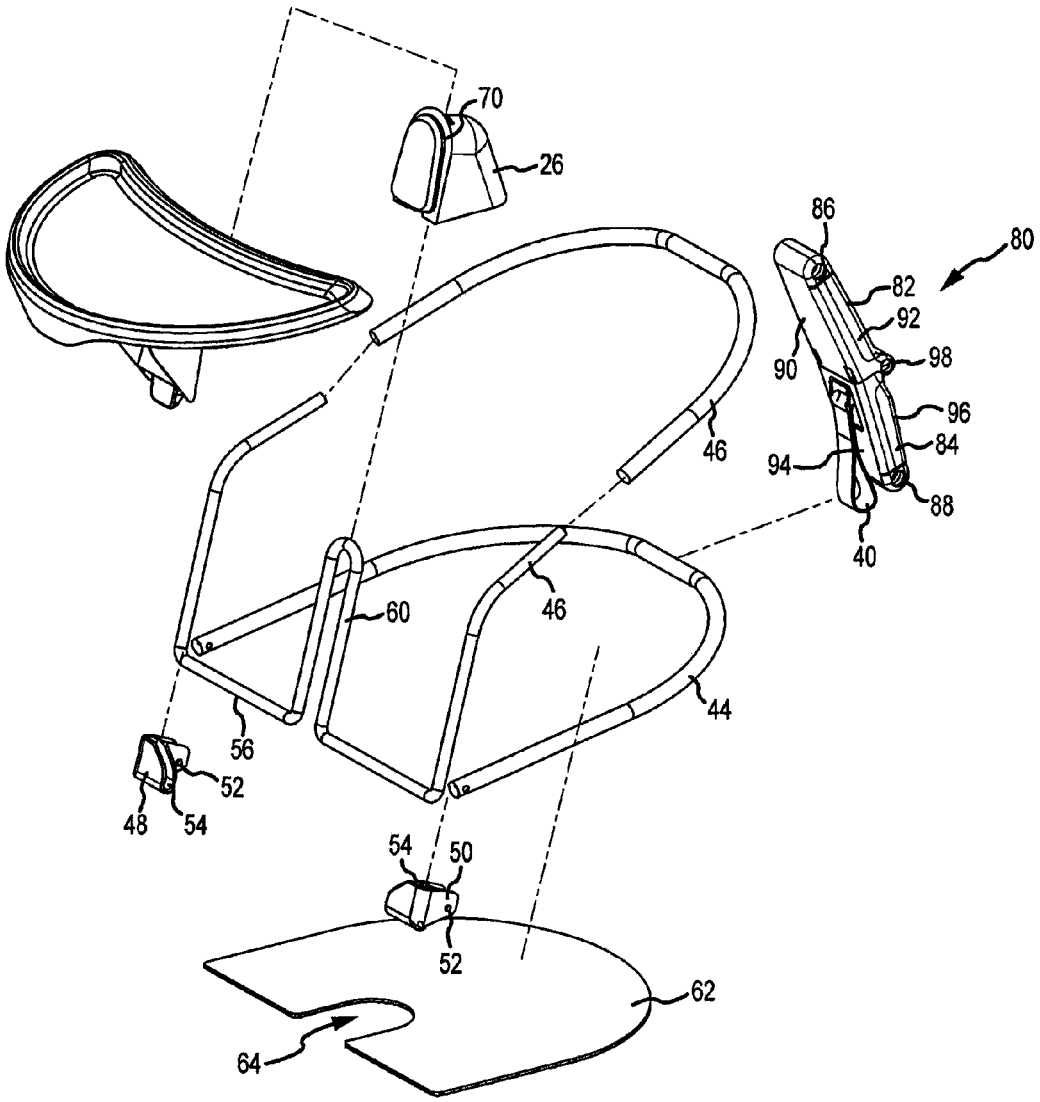
FIG. 14 is an exploded view of the chair of FIG. 13.

Referring also now to FIGS. 12-14, frame 14 will be described in greater detail. Frame 14 is constructed of various components that are combined together using various hinged or pivotal connections in order to permit the chair to easily move from the extended to the collapsed position as previously described. For example, frame 14 may be conveniently described in terms of a base portion 44 and a seat portion 46. Base portion 44 is constructed of one or more tubular members, such as metal tubing, that form a generally "U" shape. Base portion 44 is intended to rest on the ground or other support surface. In this way, base portion 44 provides general stability to the chair 10 when resting upon a support surface. Seat portion 46 is pivotally coupled to base portion 44 using pivotal connectors 48 and 50. Pivot pins 52 extend through openings in pivotal connectors 48 and 50 as well as through base portion 44 to permit pivotal connectors 48 and 50 to rotate relative to base portion 44 when moved to the collapsed position as best illustrated in FIG. 12. Pivotal connectors 48 and 50 also each include a groove 54 into which seat portion 46 is press fit to secure pivotal connectors 48 and 50 to seat portion 46. In turn, seat portion 46 may include bottom sections 56 and 58 that slide within grooves 54 to secure them to pivotal connectors 48 and 50. Bottom sections 56 and 58 are also designed to rest upon a support surface to help provide stability to seat portion 46.

Seat portion 46 may also be constructed of various lengths of tubing, such as metal tubing, that form the framework for back 16 and side arms 18 and 20. In some cases, the tubing may be of different diameters so that one length of tubing may be inserted into another length of tubing as shown in FIG. 14. Further, seat portion 46 may include a center section 60 that extends vertically upward from bottom sections 56 and 58. Center section 60 is designed to hold horn 26 in place. Also, it will be appreciated that any of the other frames described herein could be used with chair 10.

Cover 12 is designed so that it will fit over frame 14, with seat portion 46 serving as the framework which holds seat 24 in place. More specifically, cover 12 may include slotted regions in the areas of side arms 18 and 20 and back 16 into which seat portion 46 slides. This in turn permits seat 24 to be suspended from frame 14. Conveniently, a seat member 62 may be coupled to seat 24 to provide additional structural stability to seat 24. For example, seat member 62 may be held within a fabric pocket of seat 24 to hold it in place. However, other techniques may be used to couple seat member 62 to seat 24, such as by using tacks, rivets, glue, flanges, and the like. Seat member 62 may be constructed of a relatively thin and rigid material, such as fiberboard, masonite, wood, plastic (corrugated, fluted or the like), a composite, or the like. Seat member 62 may also include a recessed region 64 to permit seat member 62 to fit around horn 26. In some cases, cover 12 may be constructed similar to the other embodiments of covers described herein.

Cover 12 may be sized so that the bottom of cover 12 fits around base portion 44 and bottom sections 56 and 58 of seat portion 46 as best illustrated in FIG. 9. Cover 12 can include one or more connectors 66 that fit around base portion 44 to hold cover 12 securely in place about frame 14. Connectors 66 may comprise any one of a variety of connectors, such as fabric loops, flanges, clips, and the like that may be strategically placed about base portion 44 and bottom sections 56 and 58. In some cases, the bottom of cover 12 could include an elastic material that is sewn to the cover which permits the cover to cinch itself about frame 14. Also, cover 12 may be designed so that it is not intended to be removed by the user. However, in some cases (and as also described with other embodiments), cover 12 may be configured to be removable from frame 14 for easy washing. In some cases, cover 12 may be constructed of a fabric material that is wipeable so that it may be easily cleaned from stains or other materials, such as food, that come into contact with cover 12. Wipeable fabrics may be constructed of a fabric with a laminate or coating that is water repellant or waterproof. For example, the fabric could be a cotton blend with a plastic laminate or other waterproof coating. Friction pads 67 (or other friction materials) may be included on the bottom of cover 12 to help prevent chair from slipping on a support surface.

In some cases, a padding material may be placed or wrapped around seat portion 46 of frame 14 to provide additional padding or comfort to the user. Examples of padding materials that may be included about frame 14 include foamed materials, rubber, fabrics and the like. For example, foam padding of about 0.5 inch thickness may be placed about the metal tubes forming seat portion 46. As another option, various types of padding materials may be included within cover 12. This may be as an alternative or in addition to the padding provided about frame 14. For example, additional padding may be provided in seat 24, along back 16 and/or along side arms 18 and 20. Examples of padding materials that may be used in cover 12 include additional fabric, fiber filled materials, fiber balls, gels, foams, and the like. As still another option, various padding materials may be included about the portion of seat 24 that rests over horn 26. In this way, the area between the baby's legs may come into contact with a padding material rather than the horn itself.

Figure 14A:
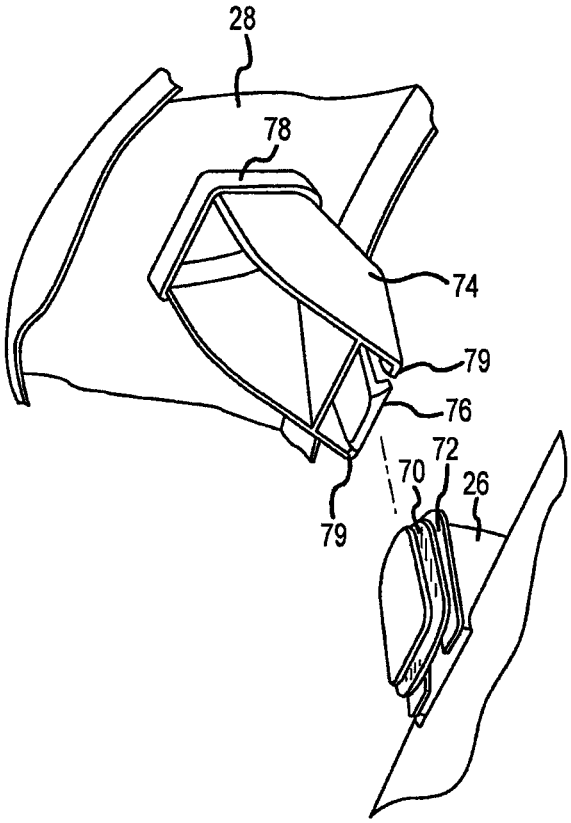
FIG. 14A is a more detailed view of a latching mechanism of the tray of FIG. 14.
Figure 14B:
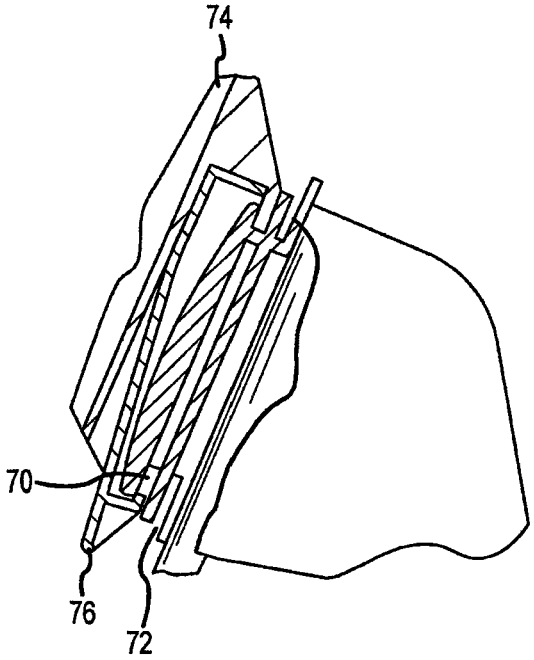
FIG. 14B is a cross-sectional side view of the latching mechanism of FIG. 14A when coupled to the horn.

As best shown in FIGS. 14, 14A and 14B, horn 26 includes a pair of slots 70 and 72 that are positioned at the front of horn 26. Slot 70 is an outer slot while slot 72 is an inner slot. Extending from the bottom of tray 28 is a neck 74 which includes a latch 76. Neck 74 may be coupled to tray 28 by inserting it into a raised feature 78 on the bottom of tray 28 as best shown in FIG. 14A. Latch 76 may comprise a piece of rigid plastic that is screwed or otherwise attached to neck 74. In this way, latch 76 is resilient in the lateral direction and is generally biased toward the right as shown in FIG. 14A. In this manner, tray 28 may be coupled to horn 26 by inserting rails 79 on neck 74 into outer slots 70. In so doing, latch 76 is moved toward the left as it slides over the front surface of horn 26. When fully inserted, latch 76 slips over the edge of horn 26 and locks within outer slot 70 as illustrated in FIG. 14B. Latch 76 therefore locks neck 74 to horn 26, thereby preventing removal of tray 28. To remove tray 28, a finger is placed beneath latch 76 and it is pulled outward until it disengages from outer slot 70. Tray 28 then may be pulled upward to slide rails 79 from slots 72. Inner slots 72 may be used to couple the fabric of the cover (or other covering fabric) to horn 26.

Figure 3:
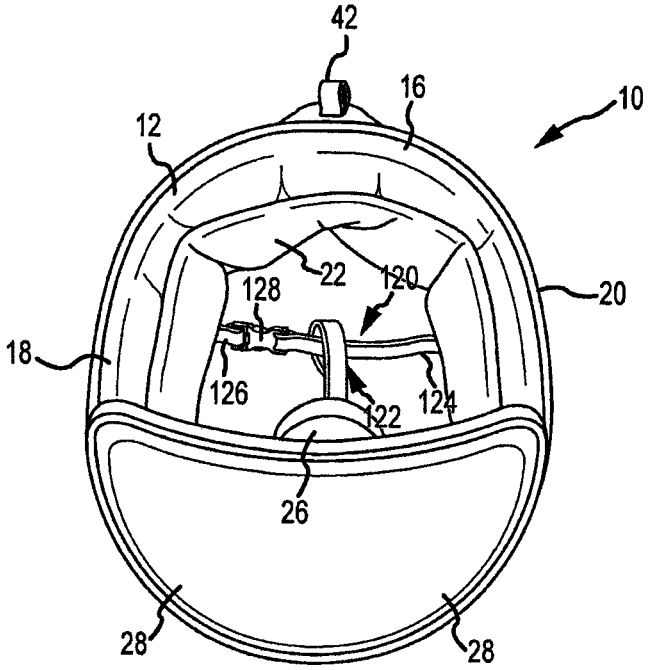
FIG. 3 is a top view of the chair of FIG. 1.
Figure 4:
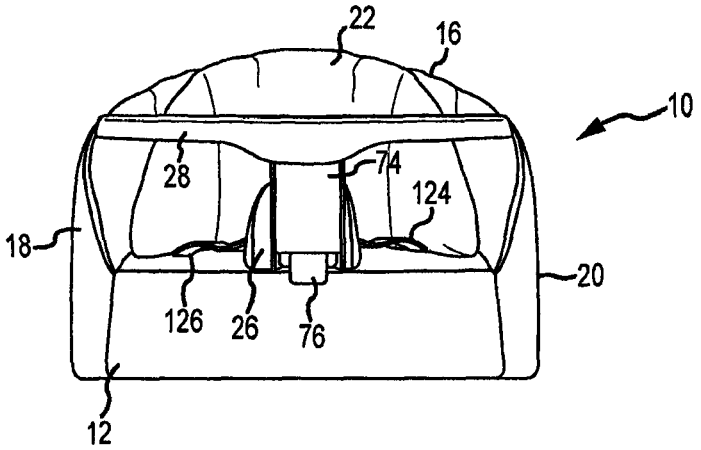
FIG. 4 is a front view of the chair of FIG. 1.
Figure 5:
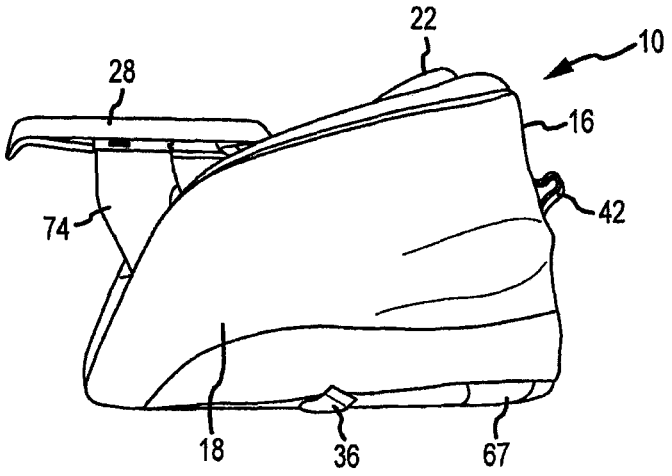
FIG. 5 is a side view of the chair of FIG. 1.
Figure 6:
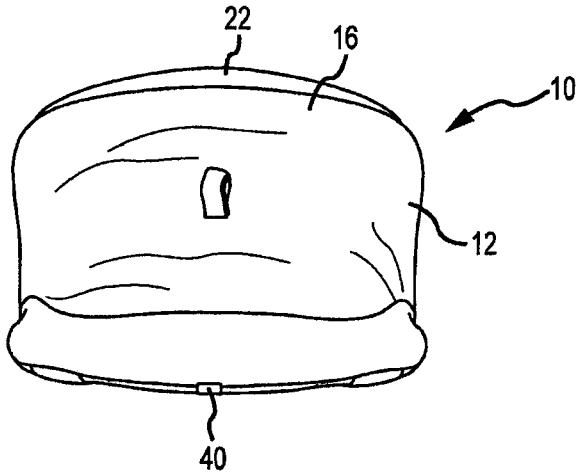
FIG. 6 is a rear view of the chair of FIG. 1.

As best shown in FIG. 3, chair 10 may also include a restraint system 120 that may be secured about the baby to further secure the baby within chair 10. Restraint system 120 may comprise a loop 122 that extends from the base of horn 26. Extending through loop 122 is a strap 124 which is coupled to another strap 126 using a connector 128. Connector 128 may comprise a clip that easily permits strap 124 and/or 126 to be uncoupled from each other by simply pushing resilient fingers on the ends of the straps to remove them from the clip housing. In use, a baby is placed within seat 24, with horn 26 positioned between the baby's legs. Loop 122 is also positioned between the user's leg and strap 126 is placed through loop 122 and then coupled to strap 126 using connector 128. Various length adjustment mechanisms may be provided on loop 122 or straps 124 and 126 to adjust their length so that the restraint system 120 may be modified based on the baby's size.

Figure 15:
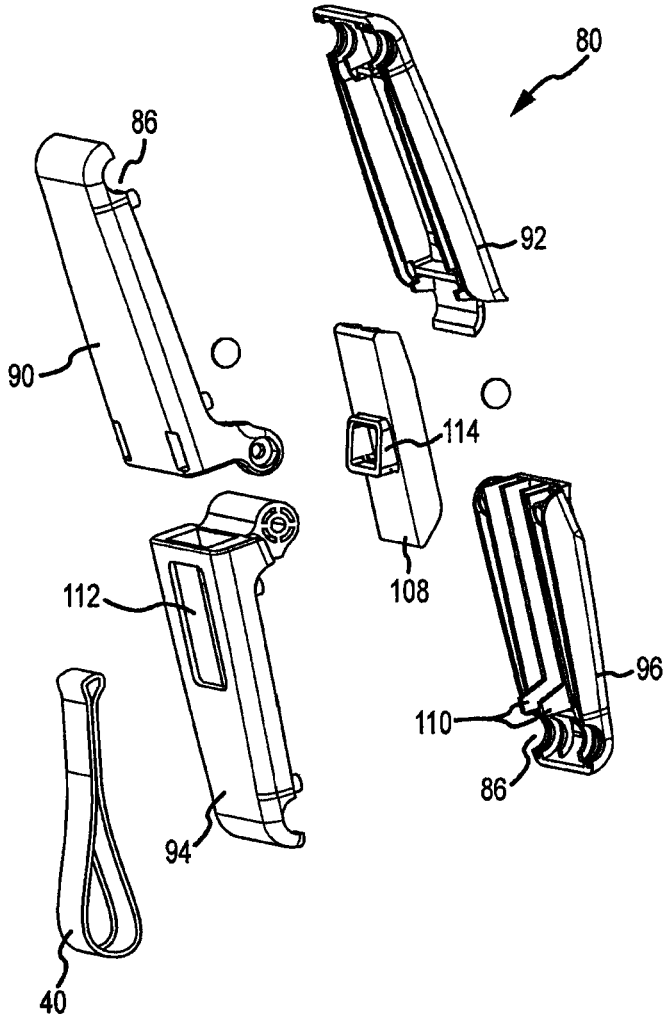
FIG. 15 is an exploded view of a locking mechanism of the chair of FIG. 14.

To lock chair 10 in the extended position, a locking mechanism 80 is employed. Locking mechanism 80 is shown in greater detail in FIG. 15. For convenience of discussion, locking mechanism 80 may be defined in terms of an upper member 82 and a lower member 84. Upper member 82 includes a through hole 86 while lower member 84 also includes a through hole 88. This permits locking mechanism 80 to be pivotally coupled to seat portion 46 and base portion 44 by positioning the metal tubes through holes 86 and 88 as best shown in FIG. 13 (which is in the extended position). Upper member 82 may be formed of pieces 90 and 92, while lower member 84 may be constructed of pieces 94 and 96 as illustrated in FIG. 15. Each of pieces 90-96 includes a semicircular opening that forms holes 86 and 88 when pieces 90 and 92 are joined and pieces 94 and 96 are joined.

Locking mechanism 80 also includes a hinge 98 that is constructed of a cylindrical member 100 on piece 94 and a pair of circular arms 102 and 104 that extend from piece 90. Arms 102 and 104 fit on either side of cylindrical member 100. Further, a bolt or pin 106 (see FIG. 13) is placed between arms 106 and cylindrical member 100 to provide the pivotal connection for hinge 98. When assembled, upper member 82 may pivot relative to lower member 84. As locking mechanism 80 pivots, piece 90 moves in a direction toward piece 94. Locking mechanism 80 is designed so that it may not rotate in the opposite direction.

Locking mechanism 80 further includes a tooth 108 that slides within piece 96. A spring (not shown) may sit between the bottom of tooth 108 and projections 110 in piece 96 so that tooth 108 is spring loaded within lower member 84. In this way, tooth 108 will project into a central opening within upper member 82 by virtue of the bias provided by the spring. When tooth 108 is within upper member 82, locking mechanism 80 is in the locked position shown in FIG. 13 (which also corresponds to the extended position of chair 10). In order to pivot locking mechanism 80 about hinge 98, tooth 108 needs to be pulled within lower member 84 to compress the spring. This will remove tooth 108 from upper member 82 and permit locking mechanism 80 to pivot about hinge 98 so that the chair may be moved to the compressed position as illustrated in FIG. 12. To retract tooth 108 within lower member 84, tether 40 (which may be coupled to tooth 108) may be pulled downward. Piece 94 includes a window 112 through which a projection 114 on tooth 108 is positioned. This permits tether 40 to be coupled to projection 114 so that tether 40 may be pulled to slide tooth 108 further in lower member 84 to operate locking mechanism 80 and permit it to pivot about hinge 98. Tether 40 may extend beyond cover 12 for easy access. Or, bottom panel 30 could be pulled back to gain access to tether 40. Other mechanisms may also be used to operate tooth 108. further, chair 10 could include the locking mechanisms of any of the other embodiments described herein.

Figure 11:
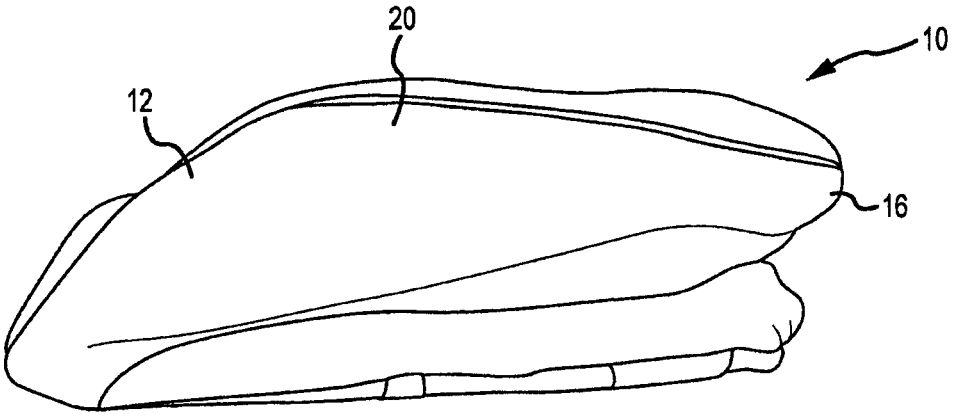
FIG. 11 is a side view of the chair of FIG. 1 shown in the collapsed position.

Hence, when chair 10 is ready to be placed in the collapsed position, a user may simply pull tether 40 downward to slide tooth 108 further within lower member 84 to free it from upper member 82. Seat portion 46 may then pivot relative to base portion 44 by virtue of pivot pins 52 until in the collapsed position shown in FIG. 12. When in the collapsed position, seat portion 46 is in the vicinity of base portion 44 to minimize the overall size and bulk of chair 10. FIG. 11 illustrates chair 10 in the collapsed position with cover 12 covering the frame. As an example, the height of chair 10 may be reduced by about half to about two-thirds of its original height. Optionally, a tote bag or other cover may be placed about chair 10 to facilitate easy transport. Optionally, a fabric handle could also be included on the back of the cover to facilitate carrying of the chair. When chair 10 is to be used, it may be placed in the extended position simply by pulling up on seat portion 46 at back 16 while holding base portion 44 steady. If needed, tab 42 may be pulled in order to facilitate straightening of locking mechanism 80. As locking mechanism 80 pivots about hinge 98, tooth 108 slides into upper member 82 where it will "click" when fully engaged. This provides an audible indication as well as tactile feedback that locking mechanism 80 is locked into place.

Figure 16:
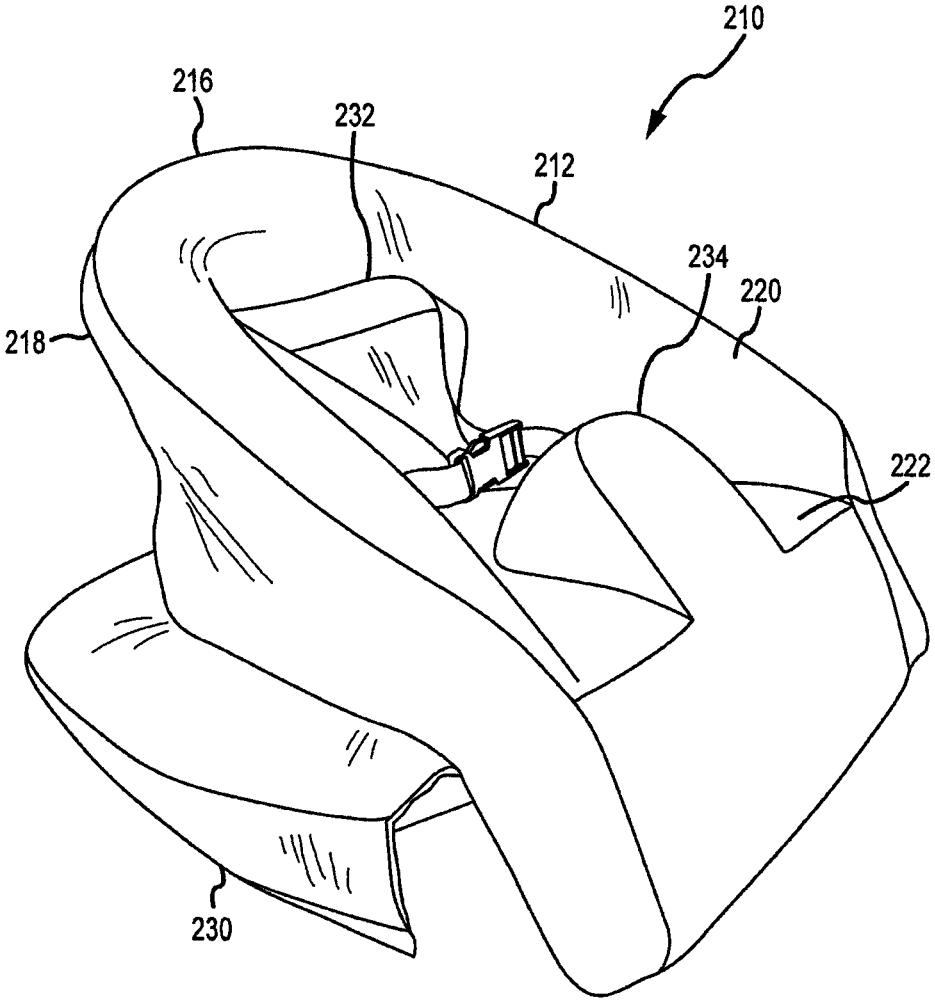
FIG. 16 is a perspective view of another embodiment of a chair according to the invention.
Figure 17:
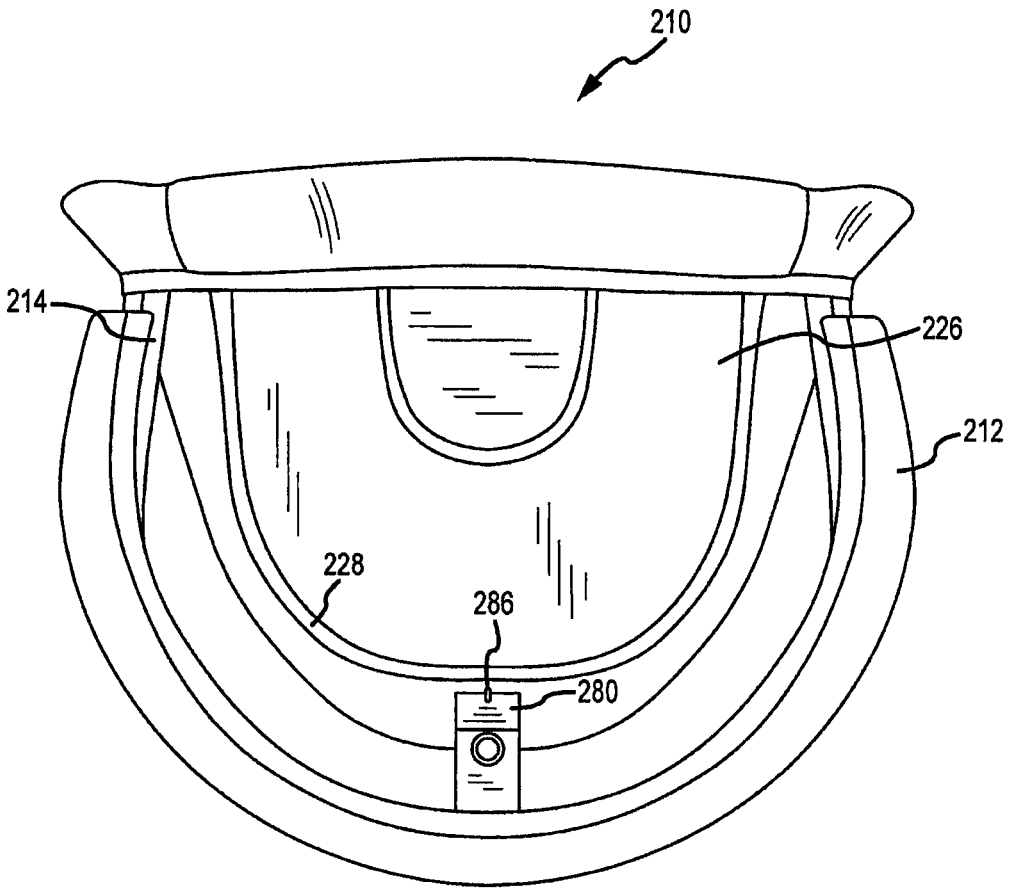
FIG. 17 is a bottom view of the chair of FIG. 16.

FIGS. 16-17 illustrate various views of another embodiment of an infant chair 210. Visible in FIGS. 16 and 17 is a removable slipcover 212 that entirely surrounds the internal frame. FIG. 17 illustrates a bottom view where the bottom of the slipcover 212 has been removed in order to view frame 214.

Slipcover 212 has a curved back 216, two curved side arms 218 and 220, and a seat 222, as well as an exterior 224 and an interior 226 (see FIG. 17). The interior 226 includes a slotted region 228 that extends along the curved arms 218, 220 and curved back 216 to receive the frame 214. By inserting frame 214 into slotted region 228, seat 222 of slipcover 212 essentially hangs or is suspended from frame 214. Further, slipcover 212 may be constructed by sewing several pieces of fabric together into the desired shape. Slits, openings or the like may be provided to facilitate placement of slipcover 212 over frame 214. Further, a bottom periphery 230 of slipcover 212 may optionally include an elastic or other material that constricts to help hold the slipcover 212 to frame 214. In one embodiment, the bottom of the slipcover 212 may have an outer periphery that is about the same or smaller than the frame. One or more slits may be included to provide flaps at the bottom end to facilitate stretching of the slipcover about the frame. Once over the frame, the tight fit helps to prevent it from slipping from the frame.

A safety belt 232 or other type of harness or strap arrangement may be used to help hold the infant within the chair. This arrangement may be fixed at various locations, such as a two point or three point harness, to ensure the baby remains seated within the chair.

Chair 210 may further include a horn 234 that is formed as a raised region that fits between the infants legs. Horn 234 serves various functions, including helping to hold the infant within the chair as well as to serve as a platform for holding other items, such as a tray or toys.

A variety of materials may be used to construct slipcover 212, such as a wipeable fabric that allows for easy cleaning of spills or other food. In some cases, slipcover 212 may be constructed of a washable fabric to permit the entire slipcover to be washed in a sink, washer or the like. Further, a padding or fill material may be incorporated into slipcover 212 to give it a comfortable and luxuriant feel. Other materials that could be incorporated into slipcover 212 include visco elastic materials, foamed materials, loosely arranged fibers, and the like. The use of these materials in combination with frame 214 provides a comfortable sitting arrangement for the infant.

As best shown in FIG. 17, a support 240 may be positioned beneath seat 222 to provide additional support to the chair. Support 240 may comprise any generally rigid material, such as a fiberboard, masonite, wood, plastic (corrugated, fluted or the like), a composite, and the like, and may be covered in fabric. Support 240 may be U-shaped in geometry, with the outer edges outlining slot 228 and the inner edges outlining horn 234. As described hereinafter, the horn may be formed as part of frame 214 and fit within a fabric dome on slipcover 212 in order to form horn 234. As an alternative, a stiff or hard material could be included within slipcover 212 in order to form the horn. Support 240 may be permanently connected to or incorporated within slipcover 212 or may be removably attached.

A panel (not shown) may be placed across bottom periphery 230 to prevent access into the interior 226. The panel may be removably attached, such as with a fastener (e.g. a zipper, hook and loop fastener material, buttons, and the like) so that the user can easily gain access into interior 226 when needing to disassemble chair 210 as described hereinafter.

Chair 210 may optionally include securing straps (not shown) that may be coupled to slipcover 212 or frame 214 and used to help secure chair 210 to another object, such as to an adult chair. For example, straps could be provided that extend around the seat of a chair as well as the back of a chair so that chair 210 functions as a booster seat. The bottom panel may be constructed of a non-skid fabric or include a non-stick material to help prevent chair 210 from moving along a support surface.

Figure 18:
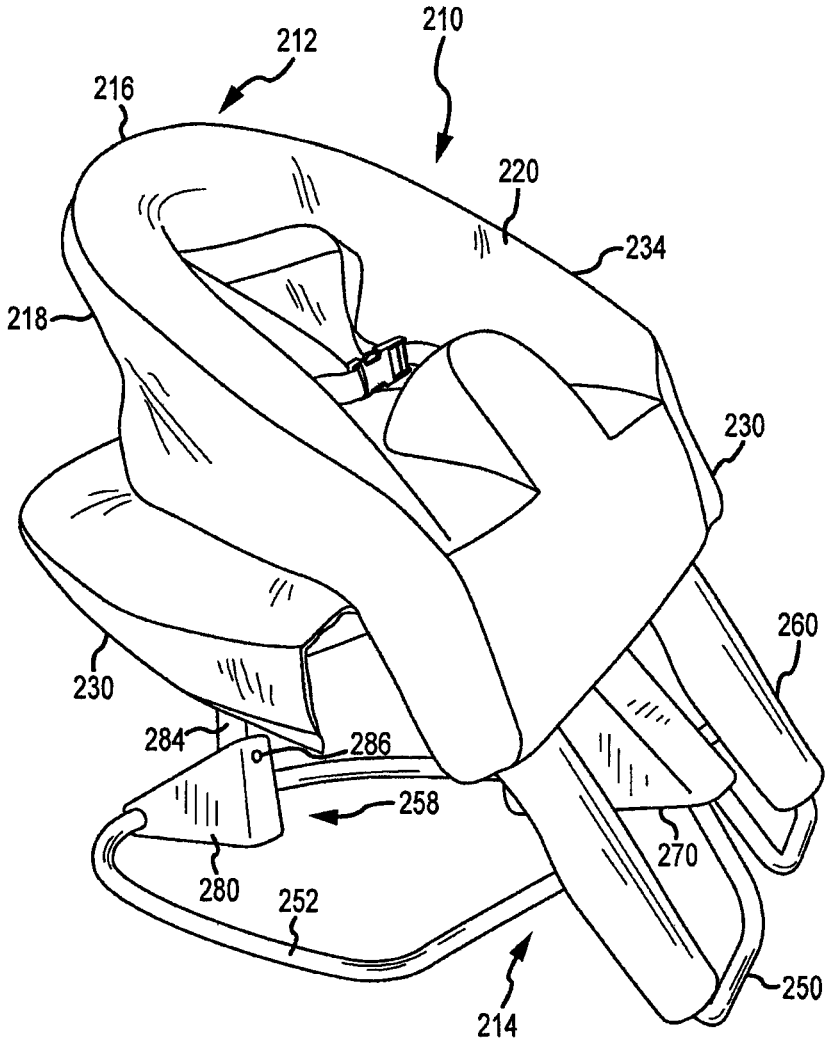
FIG. 18 is a perspective side view of the chair of FIG. 16 where the slipcover is nearly removed.
Figure 19:
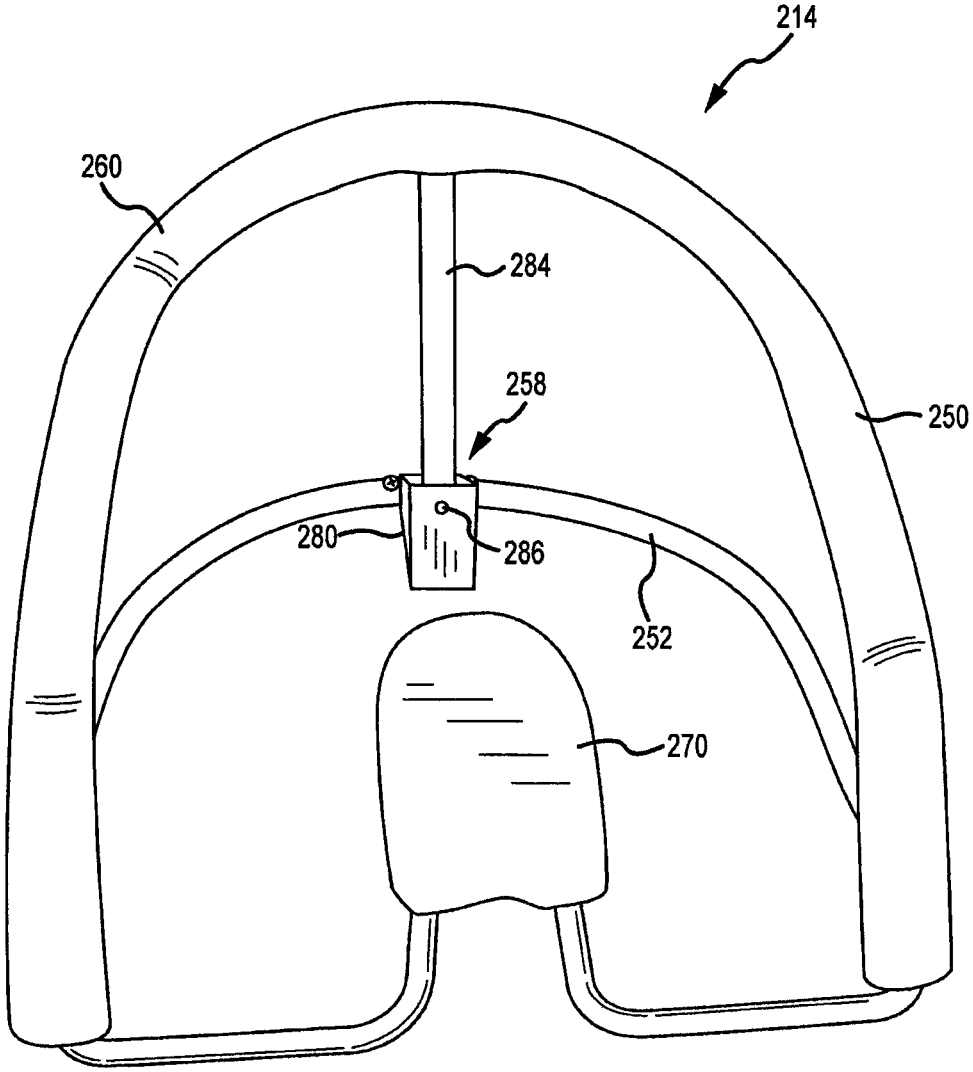
FIG. 19 is a front perspective view of a frame of the chair of FIG. 16.
Figure 20:
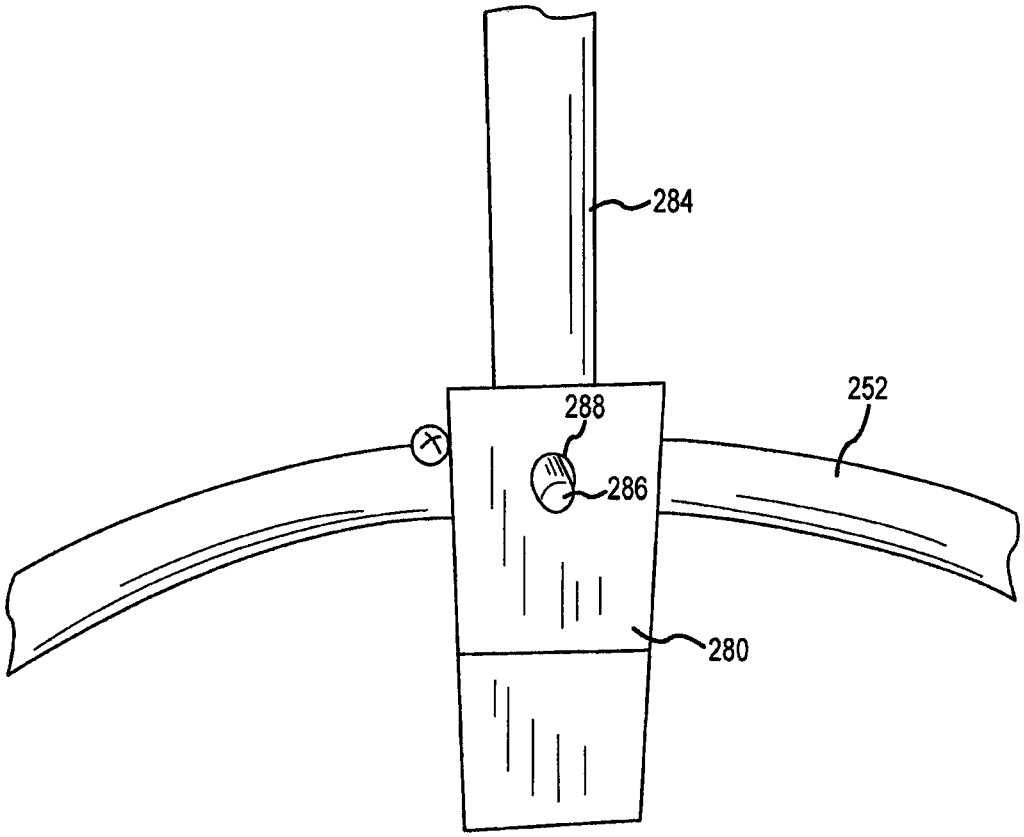
FIG. 20 illustrates a locking mechanism of the frame of FIG. 19.

Shown in FIG. 18 is a process for removing slipcover 212 from frame 214. As previously described, a bottom panel may be removed or loosened so that bottom periphery 230 may be stretched and lifted over frame 214. Slits in slipcover 212 help to lift it over the bottom of frame 214. Once bottom periphery 230 is disengaged from frame 214, slipcover 212 may be lifted up and off of frame 214. Because slipcover 212 is constructed primarily from fabric, it may easily be folded into a compact arrangement for storage or transport.

Frame 214 is further illustrated in FIGS. 19-22. Frame 214 may be constructed from a seat portion 250 and a base portion 252. These two components may be pivotally connected to each other at hinge locations 254 and 256 and a locking mechanism 258 may be operated to permit frame 214 to be moved from the expanded position of FIG. 19 to the collapsed position of FIG. 22. The components used to construct frame 214 may comprise curved elongate members that define an outer shape of the chair. For example, frame 214 may be constructed of rigid tubing, rods or the like. Materials such as steel, metal, plastic or the like may be used. These elongate members may be constructed in various segments and connected together, or formed as a continuous piece. For instance, base portion 252 may be constructed of two pieces of steel tubing that are jointed at locking mechanism 258. In a similar manner, seat portion 250 may be constructed from two pieces of steel tubing that are joined at an opposite end of locking mechanism 258. Optionally, padding 260 may be placed onto various portions of frame 214 to provide a more comfortable chair.

As previously described, horn 234 may be constructed in a variety of ways. One way is to include a horn member 270 on frame 214. For example, horn member 270 may be coupled to base portion 252 and may comprise a molded plastic or foam, with an optional skin. In this way, horn member 270 will fit within the fabric dome of slipcover 212 so as to form the shape of horn 234. In some cases, the fabric forming horn 234 may include slits (or be removed altogether) to facilitate attaching various items to horn member 270. For instance, a tray may be coupled to horn member 270 and be positioned above the infant's lap. Horn member 270 may include various coupling arrangements to permit the tray to be removably attached to chair 210. As one example, horn member 270 could include slots, tracks, or the like to permit a connecting portion of the tray to slide into the slots or tracks. This coupling arrangement may also permit the tray to slide in and out relative to the infant's torso to enable to position of the tray to be adjusted. Further, the tray itself could include a height adjustment feature to adjust the height of the tray relative to the seat.

Locking mechanism 258 may be constructed of a base 280 that is connected to base portion 252. Base 180 may be constructed of a hard plastic, such as Delrin, and include a though hole 282 for receiving a tube 284. A spring loaded detent 286 is coupled to tube 284 and is received within an opening 288 in base 280 when in the expanded position. Detent 286 serves to lock tube 284 in an upright orientation to hold frame 214 in the expanded position.

Figure 21:
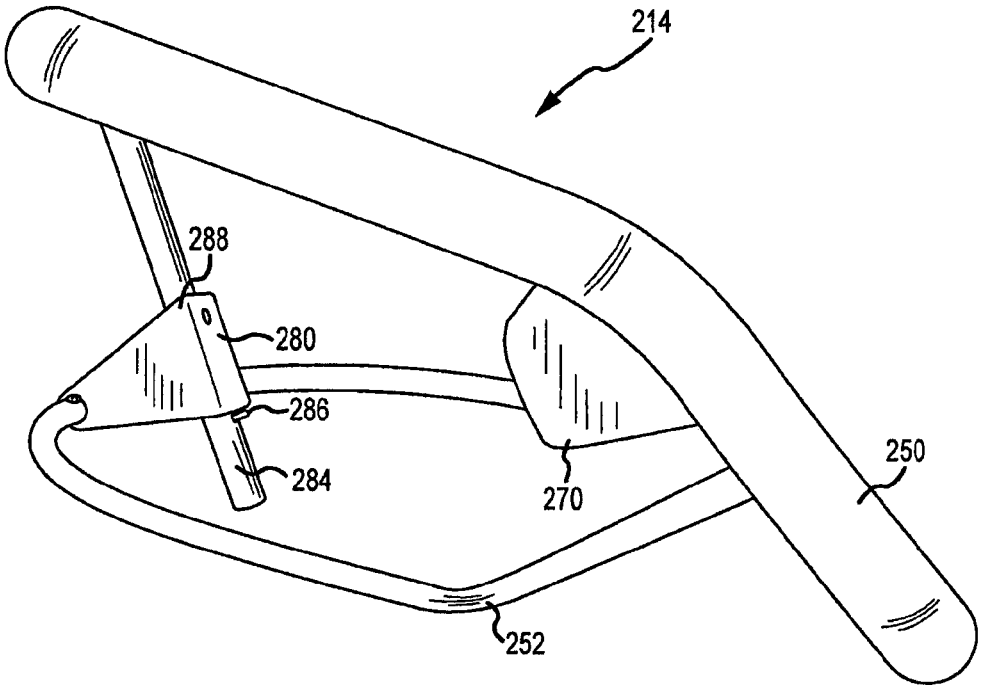
FIG. 21 illustrates the frame of FIG. 19 being moved to a collapsed position.
Figure 22:
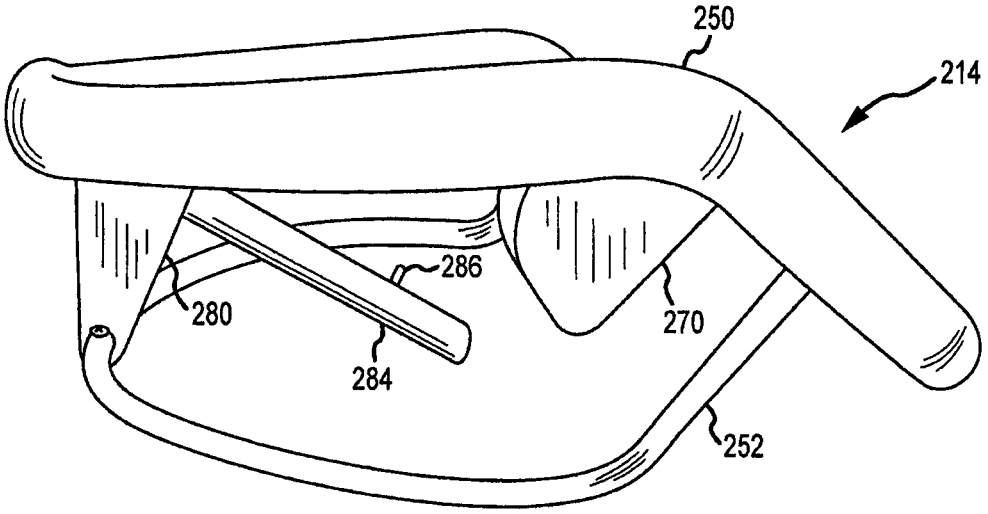
FIG. 22 illustrates the frame of FIG. 19 in the fully collapsed position.

When ready to move frame 214 to the collapsed position, detent 286 is pressed into opening 288 until it can pass lengthwise through though hole 282 as shown in FIG. 21. In so doing, tube 284 slides through base 280 and seat portion 250 pivots relative to base portion 252 as the frame 214 begins to collapse. FIG. 22 illustrates frame 214 in the fully collapsed position. To move frame 214 back to the expanded position, seat portion 250 is simply lifted while holding base portion 252 until detent 286 pops through opening 288. In this way, the chair may be assembled simply by manipulating the frame until locked into the extended position and then placing the slipcover over the frame. When needed, such as when travelling or storing the chair, the slipcover is removed from the frame and the locking mechanism is operated to permit the frame to be placed in the collapsed position. In many cases, the slipcover may remain over the frame while the chair is placed in the collapsed position. Once access is gained to the locking mechanism, the chair (with slipcover) may be collapsed.

Figure 23:
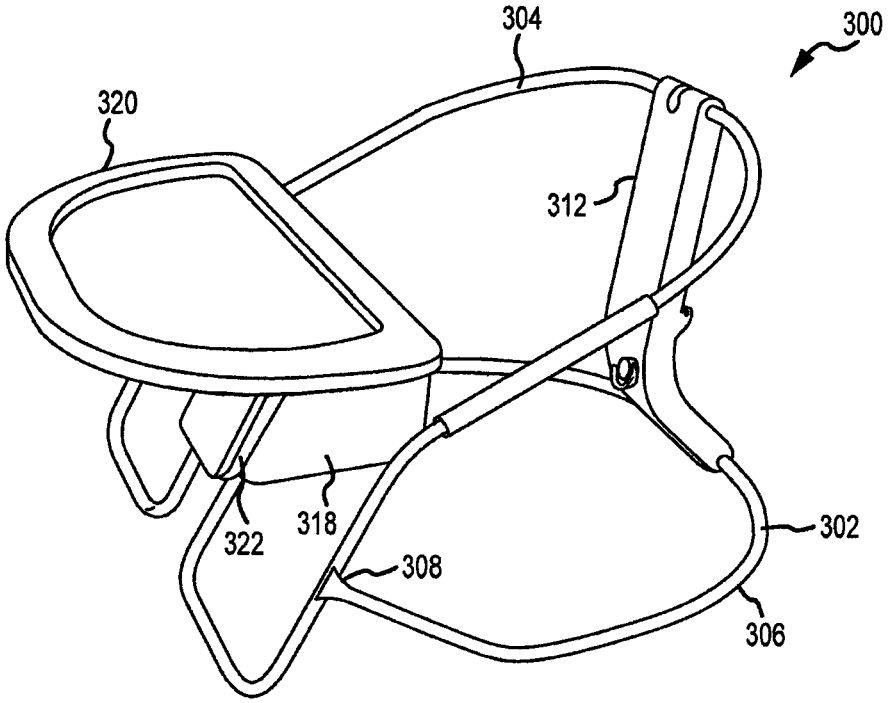
FIG. 23 is a perspective view of another embodiment of a chair frame according to the invention.
Figure 24:
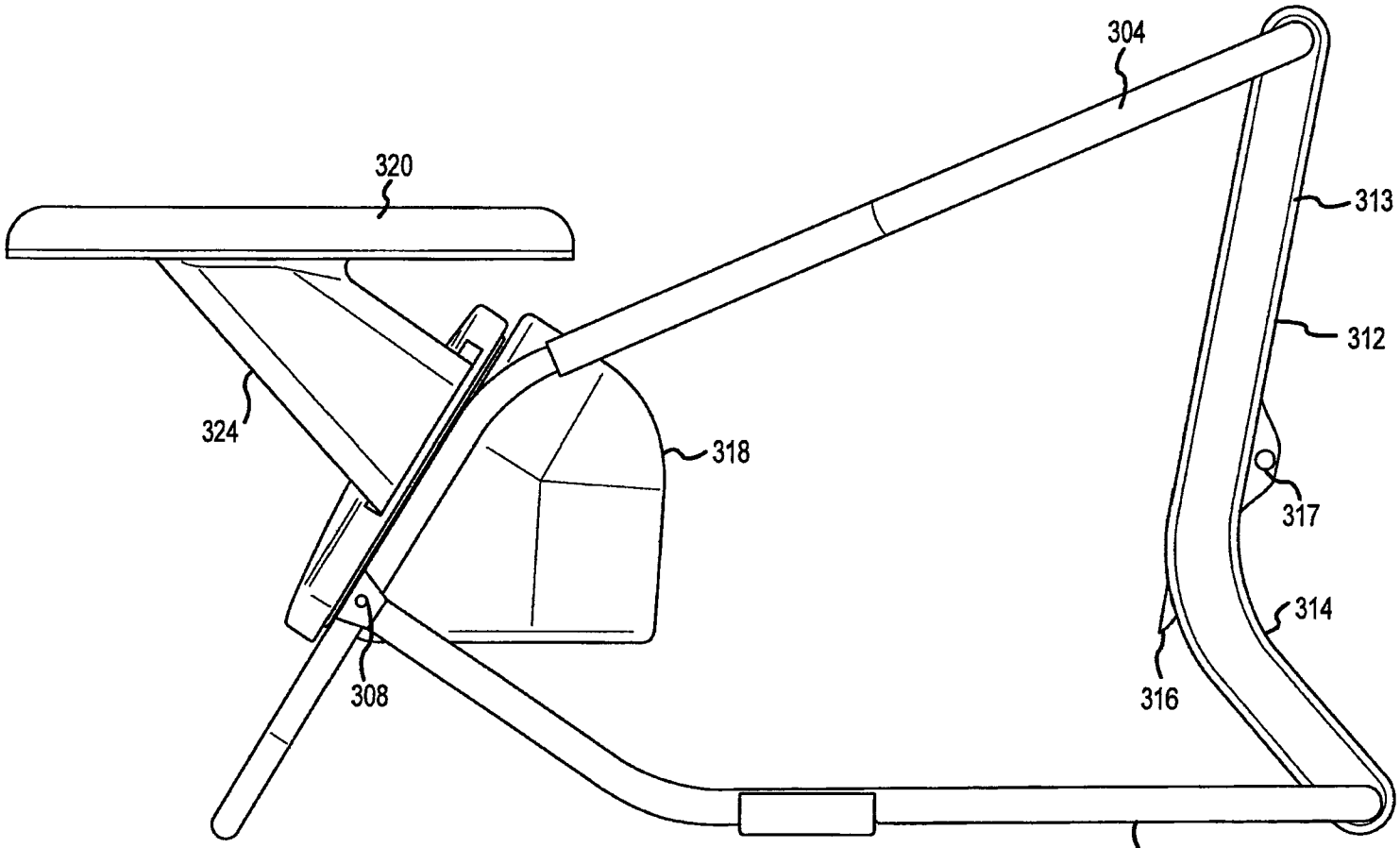
FIG. 24 is a front view of the frame of FIG. 23.
Figure 25:
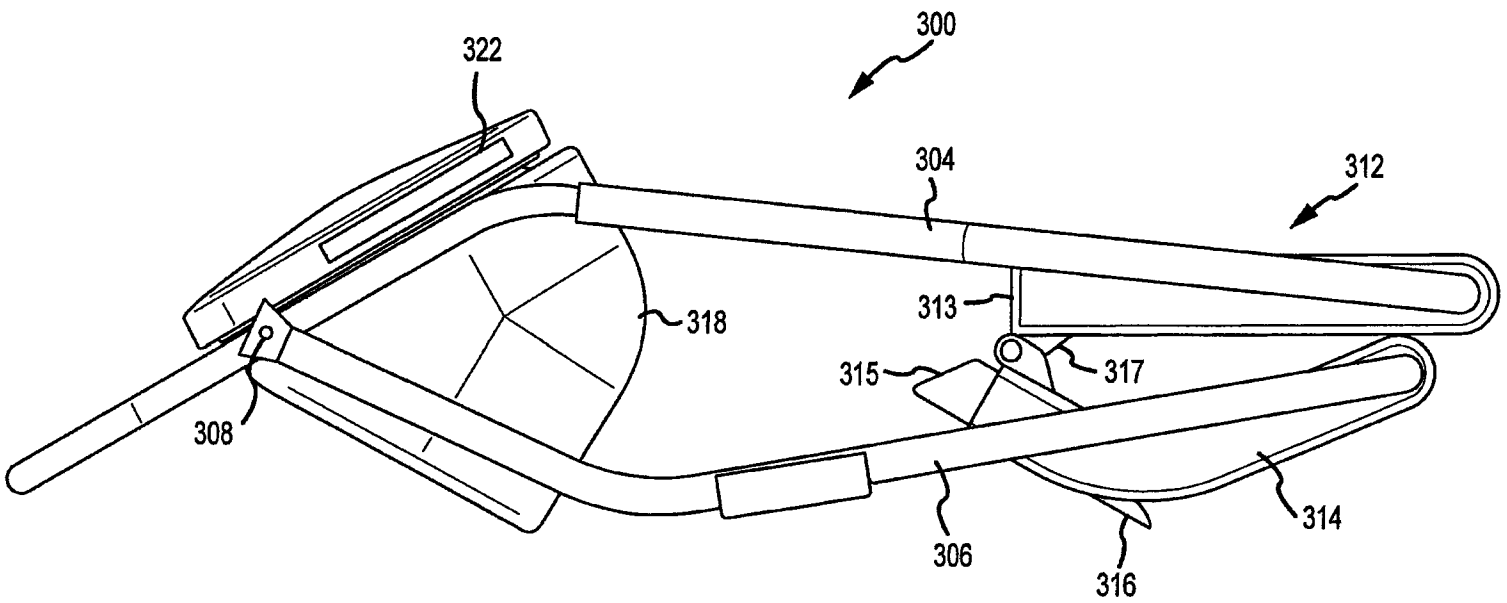
FIG. 25 is a side view of the frame of FIG. 23 shown in the collapsed position.

FIGS. 23-25 illustrate another embodiment of a chair 300 that is constructed of a frame 302. Although shown without a slipcover, it will be appreciated that a slipcover similar to those described herein may be placed over frame 302. Further, one embodiment of a slipcover that may be used will be described in connection with FIGS. 26-27. Frame 302 comprises a seat portion 304 and a base portion 306 that may be connected to each other at hinges 308 and 310. A locking mechanism 312 extends between seat portion 304 and base portion 306 and permits frame 302 to be moved from the expanded position of FIG. 24 to the collapsed position of FIG. 25. Locking mechanism 312 comprises an upper member 313 that is rotatably connected to seat portion 304 of frame 302 and a lower member 314 that is rotatably connected to base member 306. A spring loaded member 315 is set within lower member 314 and is configured to fit within an opening in upper member 313 when in the frame is in the expanded position of FIG. 24. A latch 316 is operated to pull spring loaded member 315 within lower member 314 when the frame 302 is to be moved to the collapsed position. When latch 316 is pulled, spring loaded member 315 moves out of upper member 313 and within lower member 314 and permits upper member 313 and lower member 314 to pivot about a hinge 317. As this happens, upper member 313 rotates about seat portion and lower member 314 rotates about base portion 306, permitting seat portion 304 and base portion 306 to move close to each other in the collapsed position show in FIG. 25.

To move frame 302 back to the expanded position, seat portion 304 is lifted upward while holding base portion 306 until spring loaded member 315 slides within the opening in upper member 313. To facilitate this movement, spring loaded member 315 may have an angled upper end. When fully within upper member 313, spring loaded member 315 is locked into place to lock frame 302 in the expanded position.

Chair 300 may further include a horn 318 for holding a tray 320. Horn 318 may be constructed of a moldable plastic and may include a resilient skin on its exterior surface. Tray 320 is removably attached to horn 318 to permit tray 320 to be removed when not needed, such as when placing an infant into the chair or collapsing the frame. To facilitate easy removal (and to provide adjustability as to the position of tray 320), horn 318 may include a set of tracks 322 on opposing sides of horn 318 (see FIG. 23). Tracks 322 form a slot on either side of horn 318 for receiving a protrusion on tray 320. In this way, tray 320 may be coupled to the chair simply by aligning the protrusions on the tray with the slots defined by tracks 322 and sliding the tray 320 along tracks 322. When a slipcover is placed over frame 302, the slipcover may include one or more openings or slots so that tray 320 may easily be coupled to horn 318. Further, in some cases, horn 318 may be entirely exposed (with the slipcover having an opening through which horn 318 extends). Or, the slipcover could also cover horn 318.

The position of tray 320 relative to the chair's seat may be adjustable by allowing tray 320 to be locked into place at various positions along tracks 322. Further, tray 320 could have a base 324 that is adjustable in length. As another option, tray 320 could be adjustably coupled to base 324 so that the position of tray 320 relative to base 324 could be adjusted.

Figure 26:
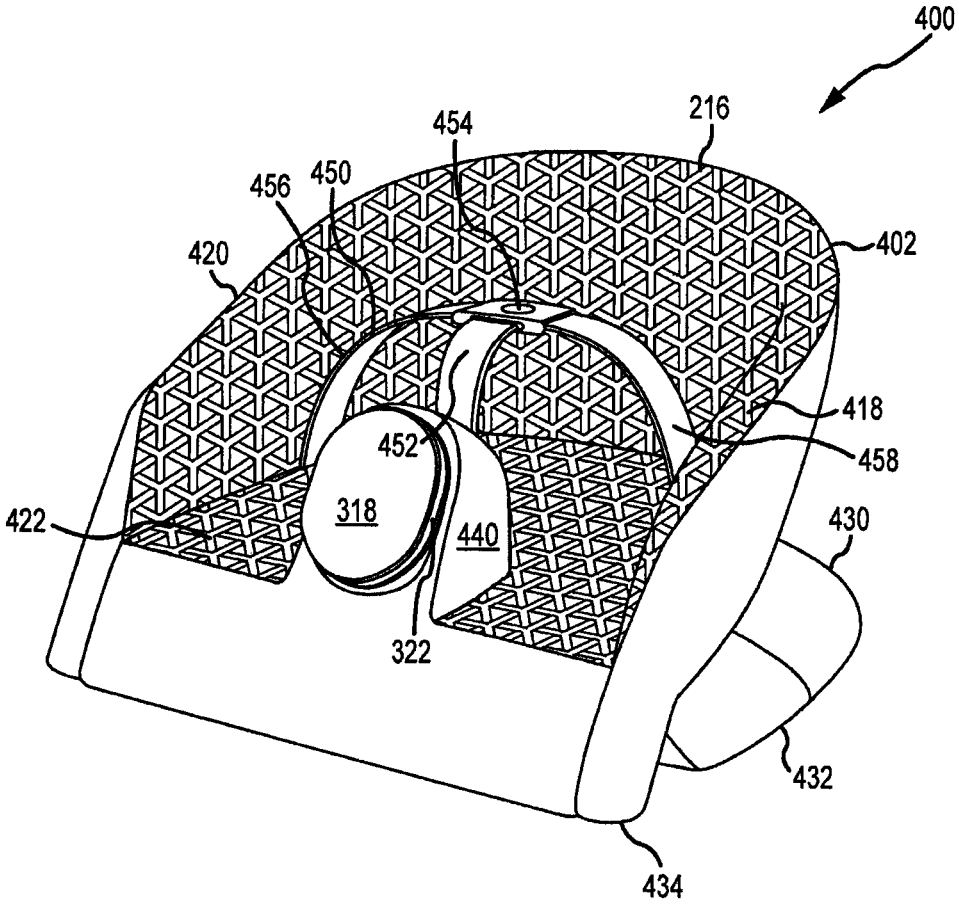
FIG. 26 is a perspective view of a further embodiment of a seat.
Figure 27:
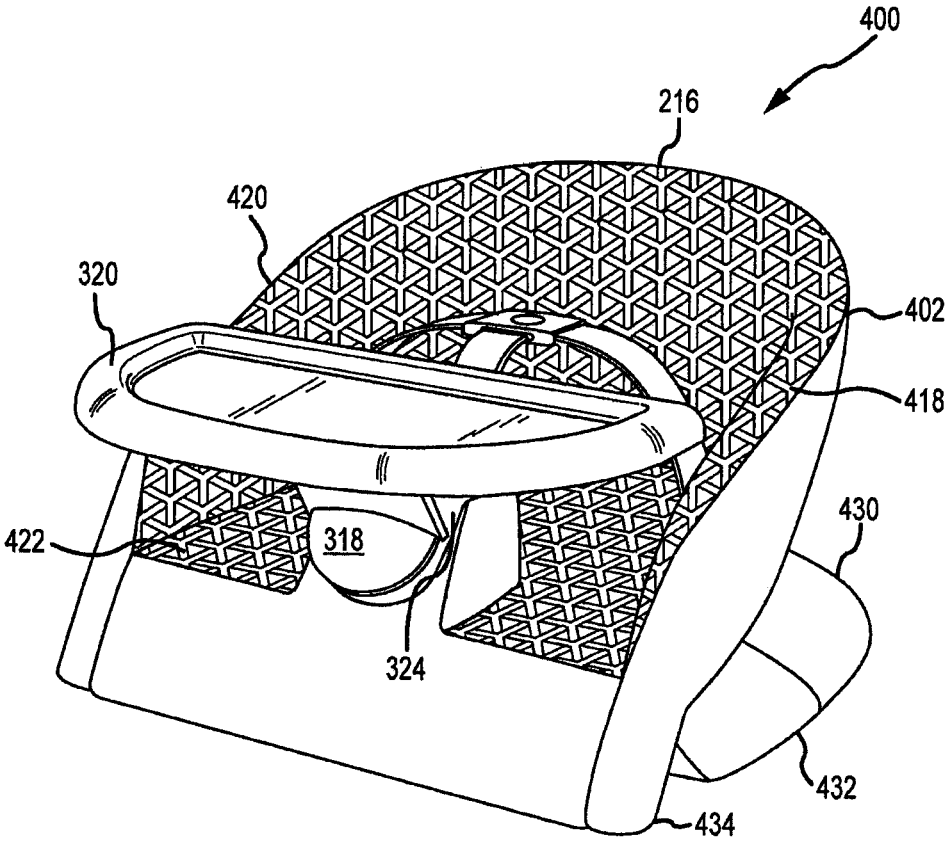
FIG. 27 illustrates the seat of FIG. 26 with a tray.

Referring now to FIGS. 26-27, another embodiment of a chair 400 will be described. As shown in FIG. 30, chair 400 includes frame 302 as described in connection with FIGS. 23-25. Chair 400 is constructed of a slipcover 402 that includes a curved back 416, two curved side arms 418, 420 and a seat 422. Slipcover 402 further includes a bottom 330 that is constructed of a skirt 432 and a front flap 434. As shown in FIG. 30, skirt 432 is configured to extend about base portion 306 while front flap 434 extends over seat portion 304. Skirt 432 and flap 434 may optionally include an elastic to permit them to be securely fastened about frame 302. Hidden from view is a bottom panel that extends across the bottom of slipcover 402.

The interior of slipcover 402 includes a slotted region that permits seat portion 304 to extend into back 416 and arms 418, 420. Further, a rigid material may be placed beneath seat 422. Extending up from seat 422 is a canopy 440 that is configured to fit over horn 318. Canopy 440 includes a front opening so that tracks 322 may be accessed when attaching tray 320 (see FIG. 31).

A safety harness 450 may be used to secure the infant within seat 422. Harness 450 has three attachment points, with a center strap 452 that fits between the infant's legs. A release button 454 is pushed to permit center strap 452 to release one or both side straps 456, 458 to allow the infant to be inserted into harness 450.

Slipcover 402 may be constructed of materials and used in a manner similar to the other embodiments described herein. For example, slipcover 402 may easily be removed from frame 302 for cleaning, transport or storage. Further, slipcover 402 could include its own horn so a horn would not need to be incorporated into the frame.

The invention has now been described in detail for purposes of clarity and understanding. However, it will be appreciated that certain changes and modifications may be practiced within the scope of the appended claims.

What is claimed is:

1. A baby seat, comprising:

a frame and a padded cover disposed about the frame, wherein the frame is movable between an expanded sitting position and a collapsed position, wherein the frame and cover define a seat, a back and two arms when in the sitting position;

a horn that protrudes from the seat so as to extend up between a baby's legs when sitting in the seat; and a tray having a neck that is removably coupleable to the horn.

2. A seat as in claim 1, wherein the frame comprises a seat portion and a base portion that are pivotally connected to each other so as to be movable between the expanded sitting position and the collapsed position, and wherein the base portion is configured to rest on a support surface.

3. A seat as in claim 1, further comprising a locking mechanism that is operable to lock the frame in the expanded position.

4. A seat as in claim 3, wherein the locking mechanism comprises a top member that is coupled to a bottom member by a hinge and a tooth that extends from the bottom member to engage the top member when in the expanded position.

5. A seat as in claim 4, wherein the tooth is retractable to disengage the tooth from the top member to permit the locking member to pivot about the hinge.

6. A seat as in claim 5, further comprising a tether that is operably coupled to the tooth, wherein the tether is pullable to disengage the tooth.

7. A seat as in claim 1, wherein the horn includes at least one groove, and wherein the neck has a protrusion that is slidable within the groove.

8. A seat as in claim 7, wherein the tray includes a latch to engage the horn.

9. A seat as in claim 1, wherein the frame comprises curved elongate members that define an outer shape of the chair.

10. A seat as in claim 1, wherein the cover further includes an elastic bottom that is configured to constrict about the frame.

11. A seat as in claim 1, wherein the cover further includes a bottom and at least one connector near the bottom to couple the cover to the frame.

12. A seat as in claim 1, further comprising a restraint system coupled to the cover that is adapted to hold a baby within the seat.

13. A baby seat, comprising:

a frame and a padded cover disposed about the frame, wherein the frame is movable between an expanded sitting position and a collapsed position, and wherein the frame and cover define a seat, a back and two arms when the seat is in the expanded sitting position; and a horn that protrudes from the seat so as to extend up between a baby's legs when sitting in the seat, wherein the horn includes a feature that is configured to couple a tray to the horn.

14. A seat as in claim 13, wherein the feature on the horn includes at least one groove, and wherein the neck has a protrusion that is slidable within the groove.

15. A seat as in claim 14, wherein the tray includes a latch to engage the horn.

16. A seat as in claim 13, wherein the frame comprises a seat portion and a base portion that are pivotally connected to each other so as to be movable between the expanded sitting position and the collapsed position, and wherein the base portion is configured to rest on a support surface.

17. A seat as in claim 16, further comprising a locking mechanism that is operable to lock the frame in the expanded position.

18. A baby seat, comprising:

a collapsible frame;

a cover that slips over the frame to define a generally horizontal seat portion and a curved, generally vertical portion that defines two arms and a backrest;

a horn that protrudes from the seat portion so as to extend up between a baby's legs when sitting in the seat portion; and a tray having a neck that is removably coupleable to the horn.

19. A seat as in claim 18, wherein the tray includes a latch to engage the horn.

20. A seat as in claim 18, wherein the frame comprises two sections that are pivotally connected to each other so as to be movable between an expanded sitting position and a collapsed position.

* * * * *